US011447947B2

(12) United States Patent
Ordener

(10) Patent No.: US 11,447,947 B2
(45) Date of Patent: Sep. 20, 2022

(54) COUPLINGS FOR COUPLING PRE-CAST CONSTRUCTION SEGMENTS TOGETHER AND PRE-CAST CONSTRUCTION SEGMENTS HAVING SUCH COUPLINGS

(71) Applicant: Optimas OE Solutions, LLC, Glenview, IL (US)

(72) Inventor: Sandrine Ordener, Sarregurmines (FR)

(73) Assignee: Optimas OE Solutions, LLC, Glenview, IL (US)

( * ) Notice: Subject to any disclaimer, the term of this patent is extended or adjusted under 35 U.S.C. 154(b) by 66 days.

(21) Appl. No.: 16/837,790

(22) Filed: Apr. 1, 2020

(65) Prior Publication Data

US 2020/0392723 A1 Dec. 17, 2020

Related U.S. Application Data

(60) Provisional application No. 62/861,942, filed on Jun. 14, 2019.

(51) Int. Cl.

| | |
|---|---|
| ***E04B 1/41*** | (2006.01) |
| ***E04B 1/04*** | (2006.01) |
| ***E21D 11/08*** | (2006.01) |
| ***B28B 23/00*** | (2006.01) |

(52) U.S. Cl.

CPC ..... *E04B 1/4114* (2013.01); *B28B 23/005* (2013.01); *E04B 1/043* (2013.01); *E21D 11/083* (2013.01)

(58) Field of Classification Search

CPC ..... E21D 11/08; E21D 11/083; E21D 11/086; E04B 1/4114; E04B 1/043

See application file for complete search history.

(56) References Cited

U.S. PATENT DOCUMENTS

| | | | |
|---|---|---|---|
| D25,868 | S | 8/1896 | Noyes |
| 3,680,277 | A | 8/1972 | Martin |
| 3,722,160 | A | 3/1973 | Bentley |

(Continued)

FOREIGN PATENT DOCUMENTS

| | | |
|---|---|---|
| EM | 008548911-0001 | 7/2021 |
| EM | 008548911-0002 | 7/2021 |

(Continued)

OTHER PUBLICATIONS

European Patent Application No. 20173523, Partial European Search Report, dated Oct. 13, 2020.

*Primary Examiner* — Andrew J Triggs

(74) *Attorney, Agent, or Firm* — Marshall, Gerstein & Borun LLP

(57) ABSTRACT

Couplings for coupling pre-cast construction segments together and pre-cast construction segments having such couplings. A construction coupling for connecting prefabricated segments includes a pair of anchors. Each anchor includes a central portion and a pair of legs. The central portion defines an elongated bore. The pair of legs extending from opposite sides of the central portion. Each leg extending in a direction generally transverse to the elongated bore and having a proximal end attached to the central portion and a free distal portion disposed away from the central portion. The construction coupling also includes a pin adapted to be received in the elongated bores of the pair of the anchors to connect the pair of anchors together.

21 Claims, 12 Drawing Sheets

(56) References Cited

U.S. PATENT DOCUMENTS

| | | | | |
|---|---|---|---|---|
| D253,392 | S | 11/1979 | Baltare | |
| D264,682 | S | 6/1982 | Van Doren | |
| 4,397,583 | A * | 8/1983 | Horncy | E21D 11/086 405/150.1 |
| 4,515,501 | A | 5/1985 | Thomas | |
| 4,830,536 | A | 5/1989 | Birch et al. | |
| D315,673 | S | 3/1991 | Paul | |
| 5,035,538 | A | 7/1991 | Mitchell | |
| D351,123 | S | 10/1994 | Graham | |
| D401,211 | S | 11/1998 | Simpson | |
| 5,876,084 | A | 3/1999 | Smith et al. | |
| D420,483 | S | 2/2000 | Abbestam | |
| D421,897 | S | 3/2000 | Washecheck et al. | |
| 6,076,995 | A | 6/2000 | Tauchi et al. | |
| D427,895 | S | 7/2000 | Morton | |
| 6,379,077 | B1 | 4/2002 | Camber et al. | |
| 6,616,377 | B1 | 9/2003 | Smith et al. | |
| 6,648,278 | B1 | 11/2003 | Kirschner | |
| 6,953,300 | B2 | 10/2005 | Chen | |
| D563,769 | S | 3/2008 | Short et al. | |
| D569,071 | S | 5/2008 | Scott et al. | |
| D588,445 | S | 3/2009 | Holdsworth | |
| 7,677,829 | B2 | 3/2010 | Westhoff et al. | |
| D632,544 | S | 2/2011 | Garcia, Jr. et al. | |
| D647,784 | S | 11/2011 | McNamara | |
| D658,053 | S | 4/2012 | Okun | |
| D663,494 | S | 7/2012 | Milliff et al. | |
| D664,822 | S | 8/2012 | Romine | |
| D669,135 | S | 10/2012 | Garfinkle | |
| D675,337 | S | 1/2013 | Peplow | |
| 9,085,977 | B2 | 7/2015 | Bonomi et al. | |
| D736,060 | S | 8/2015 | Shimizu et al. | |
| D763,066 | S | 8/2016 | Sugimoto | |
| D767,372 | S | 9/2016 | Itou et al. | |
| D793,215 | S | 8/2017 | Gallion et al. | |
| D811,869 | S | 3/2018 | Gallion et al. | |
| D815,939 | S | 4/2018 | Geiger et al. | |
| D823,672 | S | 7/2018 | Mogensen | |
| 10,017,910 | B2 | 7/2018 | Kruse | |
| D850,240 | S | 6/2019 | Breda | |
| D895,775 | S | 9/2020 | Horning et al. | |
| D930,464 | S * | 9/2021 | Ordener | D8/382 |
| 2008/0196222 | A1 | 8/2008 | Park | |
| 2008/0271297 | A1 | 11/2008 | Dubost | |
| 2008/0298903 | A1 | 12/2008 | Kim et al. | |
| 2013/0251445 | A1 * | 9/2013 | Robertshaw | F16B 21/08 403/167 |
| 2017/0096895 | A1 | 4/2017 | Bonomi | |
| 2017/0096896 | A1 | 4/2017 | Bonomi et al. | |
| 2019/0292740 | A1 | 9/2019 | Jilken | |
| 2020/0392723 | A1 * | 12/2020 | Ordener | E04B 1/043 |

FOREIGN PATENT DOCUMENTS

| | | | | |
|---|---|---|---|---|
| EM | 008548911-0003 | | 7/2021 | |
| EM | 008548911-0004 | | 7/2021 | |
| EM | 008548911-0005 | | 7/2021 | |
| EM | 008548911-0007 | | 7/2021 | |
| FR | 2400650 | * | 3/1979 | E21D 11/08 |
| FR | 2400650 | A1 | 3/1979 | |
| GB | 2139268 | A | 11/1984 | |
| GB | 2333140 | A | 7/1999 | |
| GB | 6133675 | | 4/2021 | |
| GB | 6133676 | | 4/2021 | |
| GB | 6133677 | | 4/2021 | |
| GB | 6142813 | | 6/2021 | |
| GB | 6142814 | | 6/2021 | |
| JP | H10131306 | A | 5/1998 | |
| WO | WO-2012046052 | A1 | 4/2012 | |

* cited by examiner

COUPLINGS FOR COUPLING PRE-CAST CONSTRUCTION SEGMENTS TOGETHER AND PRE-CAST CONSTRUCTION SEGMENTS HAVING SUCH COUPLINGS

FIELD OF THE DISCLOSURE

The present disclosure relates generally to construction couplings and, in particular, to construction couplings for coupling pre-cast construction segments such as ring segments together and construction segments having such couplings.

BACKGROUND

Various structures such as tunnels, walls, floor plates, roads, etc., can be manufactured and assembled using pre-cast building materials. Tunnels, specifically, can be built by assembling and securing a plurality of pre-cast rings adjacent one another along an axis of the tunnel to be formed. Depending on the size of the tunnel being built, such pre-cast rings can each include a plurality of pre-cast arcuate-shaped ring segments coupled together. Each ring segment includes opposite radial end surfaces that engage corresponding radial end surfaces of adjoining ring segments to define radial joints. Conventionally, the ring segments must be coupled together at the radial joints with bolts or other means to prevent relative movement between the ring segments. The process of bolting the ring segments together is relatively labor intensive and the bolts may be susceptible to corrosion.

SUMMARY

In accordance with a first example, a construction coupling for connecting prefabricated segments includes a pair of anchors. Each anchor includes a central portion and a pair of legs. The central portion defines an elongated bore. The pair of legs extend from opposite sides of the central portion. Each leg extends in a direction generally transverse to the elongated bore and has a proximal end attached to the central portion and a free distal portion disposed away from the central portion. The construction coupling also includes a pin adapted to be received in the elongated bores of the pair of the anchors to connect the pair of the anchors together.

In accordance with a second example, a ring of a tunnel includes a plurality of ring segments including radial end surfaces. Each radial end surface carries a pair of anchors and defines corresponding recesses. Each anchor defines an elongate bore. The ring includes a plurality of pins. Each pin is adapted to be received in the elongated bores of corresponding ones of the anchors to connect the pair of anchors together.

In accordance with a third example, a method of forming a pre-cast concrete segment carrying an omega-shaped anchor having legs and a central portion defining an elongated bore, the method includes fixing the anchor to a tool. The tool has a semi-cylindrical portion facing the elongated bore of the anchor. The method includes coupling the tool to or adjacent to a casting form. The method includes pouring concrete into the casting form to form the concrete segment. The concrete segment includes a recess formed by the semi-cylindrical portion of the tool. The method includes uncoupling the tool from the anchor. The elongated bore of the anchor opens into the recess.

In further accordance with the foregoing first, second and/or third examples, an apparatus and/or method may further include any one or more of the following:

In accordance with one example, each leg of each anchor includes a generally planar structure extending generally transverse to the elongated bore.

In accordance with another example, the pair of legs of each anchor extends at an angle relative to each other. The angle is in the range of approximately 0 degrees to approximately 90 degrees.

In accordance with another example, the free distal portion of each leg includes a tongue extending transversely away from the remainder of the leg.

In accordance with another example, each leg of the anchors includes a plurality of ribs forming a skeleton and a panel.

In accordance with another example, one or more of the anchors includes a flange that extends around at least a portion of the central portion of the anchor.

In accordance with another example, the legs have a first side and a second side and the central portion includes a protrusion. The protrusion of the central portion extends beyond the second side of the legs.

In accordance with another example, the elongated bore of each anchor includes a blind bore with an opening having a first diameter and a closed end having a second diameter that is smaller than the first diameter.

In accordance with another example, the pin includes a third diameter portion, a tapered portion, and a fourth diameter portion. The tapered portion is positioned between the third diameter portion and the fourth diameter portion. The third diameter portion of the pin is sized to be received within the opening of the blind bore and the fourth diameter portion of the pin being sized to be received within the closed end of the blind bore.

In accordance with another example, each anchor includes a generally omega-shaped anchor.

In accordance with another example, each of the anchors includes a central portion and when the radial end surfaces of two of the ring segments abut one, the central portion of the anchor carried by a first one of the ring segments is positioned within the recess of a second one of the ring segments.

In accordance with another example, each of the recesses has a semi-cylindrical shape.

In accordance with another example, each anchor includes a central portion and a pair of legs. The central portion defines an elongated bore and the pair of legs extends from opposite sides of the central portion. Each leg extends in a direction generally transverse to the elongated bore and has a proximal end attached to the central portion and a free distal portion disposed away from the central portion.

In accordance with another example, when the radial end surfaces of the ring segments are adjacent one another and the ring segments are coupled together, the anchor of one of the ring segments is positioned in the recess of another one of the ring segments.

In accordance with another example, fixing the anchor to the tool includes positioning the central portion of the anchor within an aperture of the tool and clamping the central portion within the aperture.

In accordance with another example, fixing the anchor to the tool includes positioning breakaway segments extending from a flange of the anchor within a space defined by the tool.

DETAILED DESCRIPTION

Although the following text discloses a detailed description of example methods, apparatus and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

The examples disclosed herein relate to couplings for joining segments together. The segments can be ring segments, tunnel segments, building segments, etc. The couplings provide a hinge-like structure and are relatively easy to align when coupling the segments together. As a result, the segments can be assembled in less time with less man power as compared to conventional methods. Additionally, the couplings provide a relatively high pull-out resistance and a relatively high shear resistance. Having a higher pull-out resistance and/or a higher shear resistance may be advantageous when the couplings are used in environments in which the internal pressure of the structure (e.g., the tunnel) formed by the segments is higher than the external pressure of the structure and/or when the environment poses seismic-event risks.

Figure 1:
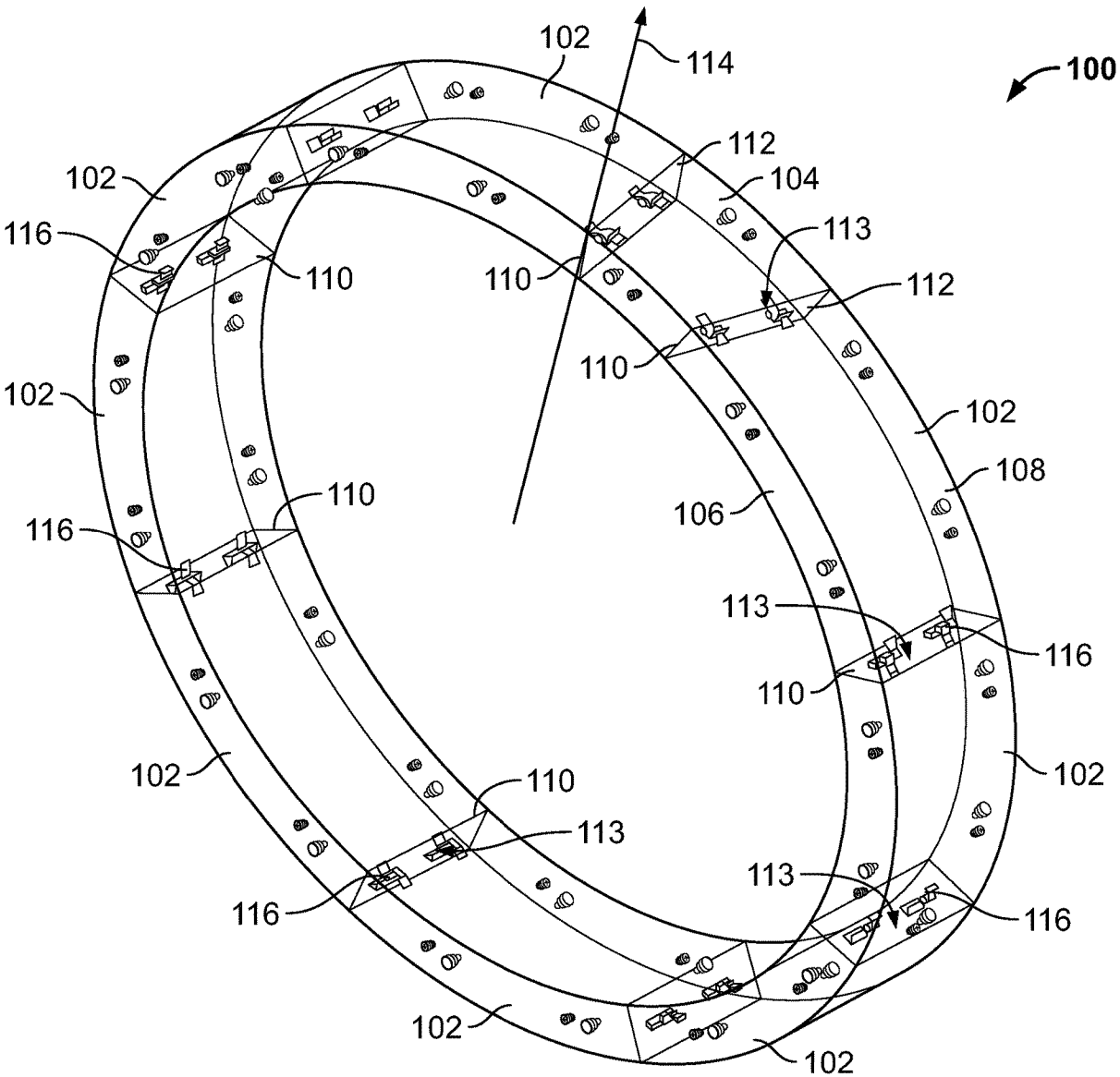
FIG. 1 is an isometric view of a ring of a tunnel in accordance with the teachings of this disclosure that includes a plurality of ring segments and a key segment. The segments engage one another at radial joints to form a circumference of the ring and are coupled together via radial couplings.

FIG. 1 is an isometric view of a pre-cast, pre-assembled ring 100 of a tunnel, for example, in accordance with a first disclosed example. The ring 100 includes a plurality of common ring segments 102 and a key ring segment (a key stone) 104. The segments 102, 104 are pre-cast concrete forms including opposite axial end faces 106, 108 and radial end surfaces 110, 112. The segments 102, 104 are configured such that when assembled in a manner shown in FIG. 1, the radial end surfaces 110, 112 abut each other to form a complete circle that defines the ring 100. To form a tunnel using the rings 100, a plurality of the rings 100 are positioned in a manner to form longitudinal joints between opposing axial end faces 106, 108 of the respective rings 100. Conventionally, fasteners (not shown) would be used to couple the rings together.

Referring now to the common ring segments 102 and the key ring segment 104, in the example shown, the common ring segments 102 are similar or the same to one another and the key ring segment 104 has a shorter radial dimension than the common ring segments 102. Where the radial end surfaces 110 of the common ring segments 102 and the key ring segment 104 abut, radial joints 113 are formed. In the example shown, the radial joints 113 are defined along or are otherwise associated with a radial vector 114 of the ring 100. Alternatively, the radial joints 113 between the common ring segments 102 and the key ring segment 104 may be defined at an angle different than an angle defined at the radial joints 113 between the radial end surfaces 110 of two adjacent common ring segments 102.

In the example shown, the segments 102, 104 are coupled together at the radial end surfaces 110, 112 via a plurality of radial couplings 116. Two radial couplings 116 couple the ring segments 102, 104 together at the radial joints 113. However, in other versions, a different number of the radial couplings 116 may be included instead. For example, each of the radial joints 113 may include one, three, four, five, etc., radial couplings 116.

Figure 2:
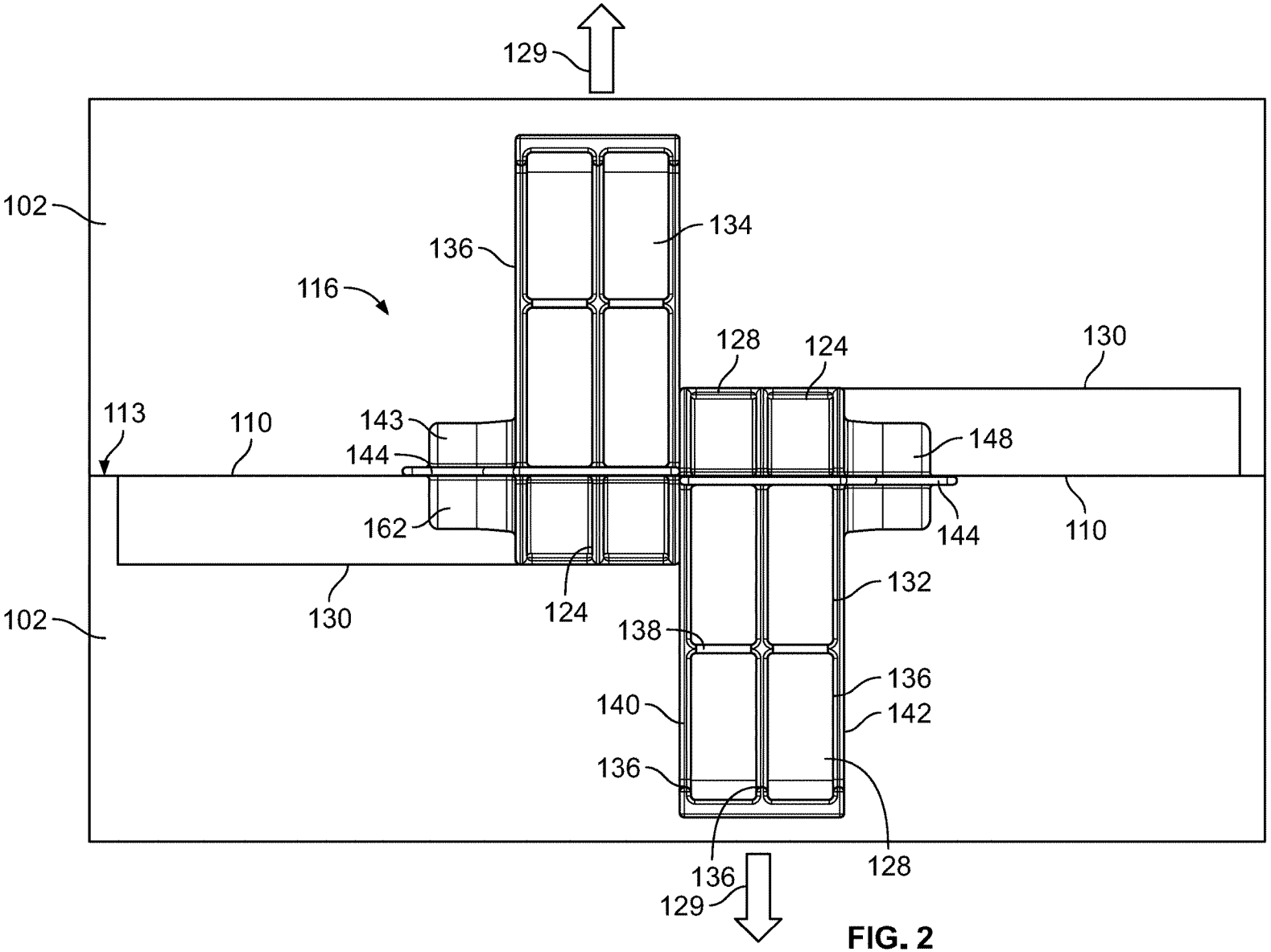
FIG. 2 is a detailed partial cross-sectional view of one of the radial joints and the associated radial coupling of the ring of FIG. 1.
Figure 3:
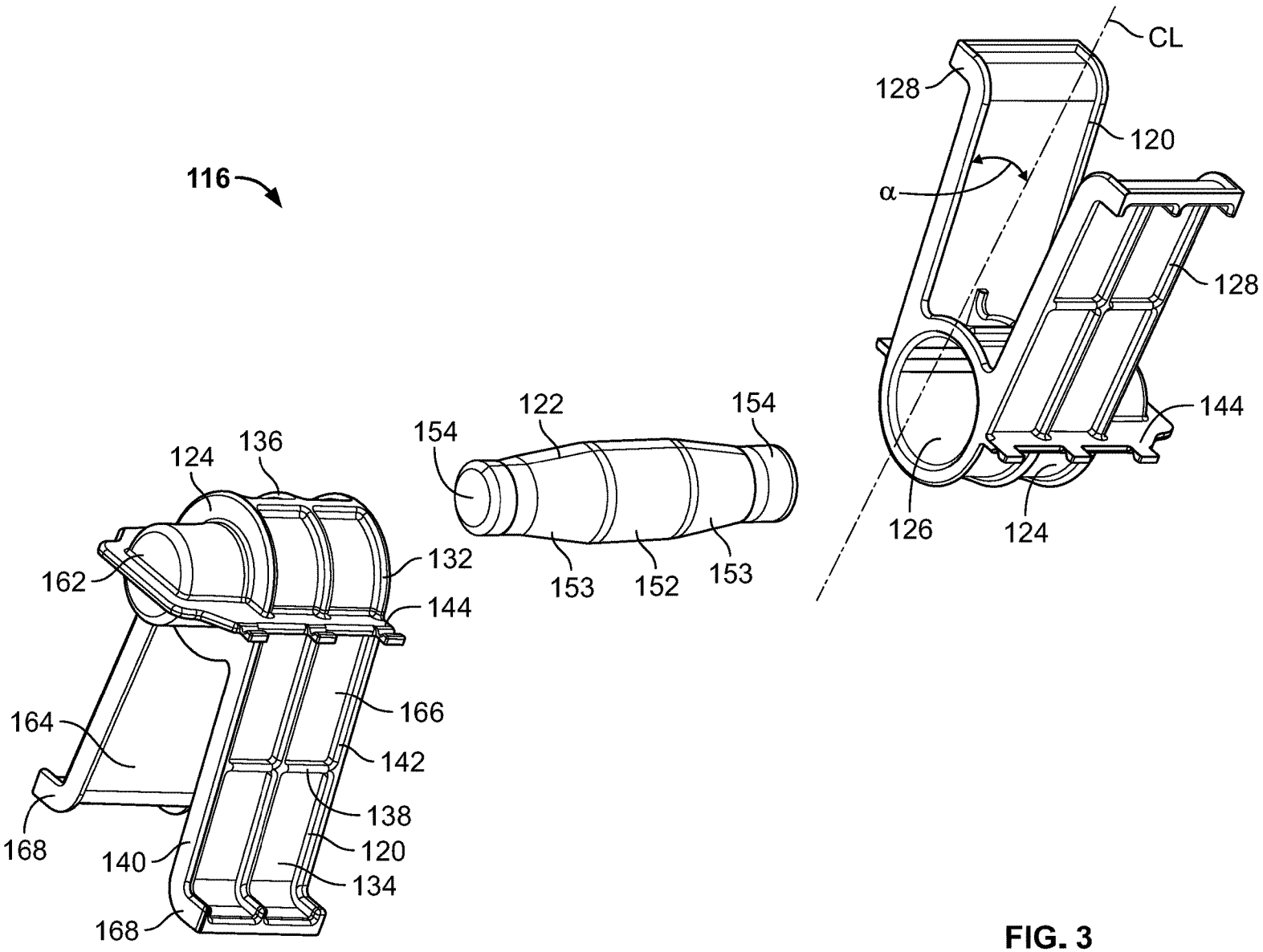
FIG. 3 is an expanded isometric view of one of the radial couplings of FIG. 1 including a plurality of anchors and a pin, where a plurality of break-away segments have been removed from the anchors after a pre-cast concreting process.

FIG. 2 illustrates a detailed partial cross-sectional view of one of the radial joints 113 and one associated radial coupling 116 of FIG. 1, while FIG. 3 illustrates the radial coupling 116 in exploded perspective. As can be seen in FIG. 3, each radial coupling 116 includes two anchors 120 and a pin 122. The anchors 120 have a central portion 124 defining a blind bore 126 and also include a pair of legs 128 that extend from the central portion 124. The pin 122 is sized to be received within the bores 126 to couple the anchors 120 together.

Referring back to FIG. 2, the abutting radial end surfaces 110 of two of the common ring segments 102 are shown forming one of the radial couplings 116 where the pin 122 is received within the bores 126 of the anchors 120. In some examples, the radial coupling 116 provides a pull-out resistance of between about approximately 100 kilonewtons and approximately 400 kilonewtons and a shear resistance of between about approximately 100 kilonewtons and approximately 400 kilonewtons. The pull-out resistance is represented by forces applied to the anchors 120 in a direction generally represented by arrows 129 and the shear resistance is associated with forces applied to the anchors 120 in a direction generally opposite and 90° relative to the arrows 129.

Referring back to the radial end surfaces 110, in the example shown in FIGS. 1 and 2, each radial end surface 110 includes a pair of recesses 130. The recesses 130 have a semi-cylindrical shape and are sized to receive the pin 122 and the central portion 124 of the radial coupling 116, as will be described further below. The recesses 130 are also sized to allow relative movement between the ring segments 102, 104 while and/or after the ring segments 102, 104 are coupled together, as will also be described below. Alternatively, the recesses 130 may have a different cross-section and/or shape than being semi-cylindrical.

In the example shown and with specific reference to FIG. 3, the radial coupling 116 includes the anchors 120 and the pin 122 (the pin 122 is most clearly shown in FIG. 3). The anchors 120 are substantially similar to one another and are substantially symmetric along a vertical plane perpendicular to the radial end surfaces 110. In this example, the anchors 120 are generally omega shaped. However, the anchors 120 may be a different shape. For example, the anchors 120 may be U-shaped, V-shaped, W-shaped, etc.

The anchors 120 include the central portion 124 and the pair of legs 128 (the legs 128 are most clearly shown in FIGS. 2 and 3). The legs 128 extend from opposing sides of the central portion 124 at an angle $\alpha$ relative to a centerline CL of the anchors 120. The angle $\alpha$ may be about 45°. In an example, the angle defined between the legs 128 is between about 45° and 90°. However, any angle between about 0° and about 90° has been contemplated. For example, the angle defined between the legs 128 may be about 30°, about 40°, about 47°, about 62°, about 70°, about 93°, etc.

Referring back to FIG. 2, the legs 128 of the anchors 120 include a plurality of reinforcing ribs 132 and a panel 134 from which the ribs 132 extend. In the depicted form, the ribs 132 include a plurality of longitudinal ribs 136 and a plurality of lateral ribs 138 intersecting the longitudinal ribs 136. As shown in FIG. 3, the longitudinal ribs 136 wrap around the anchor 120 to form a substantially omega-shape. Two of the longitudinal ribs 136 are disposed along a perimeter of the anchor 120 and one of the longitudinal ribs 136 is positioned between the exterior longitudinal ribs 127.

The lateral ribs 138 extend between sides 140, 142 of the legs 128. The lateral ribs 138 also extend between the longitudinal ribs 136. While three longitudinal ribs 136 and five lateral ribs 138 are included in the anchors 120 illustrated (see, FIG. 3 for additional clarity), any other number of ribs 132 may be included instead. For example, the anchors 120 may include four longitudinal ribs 136 and 7 lateral ribs 138. In other versions, the anchors may not include ribs at all, but rather, the legs can simply include the flat panels.

A first portion 143 of the central portion 124 includes a flange 144 (the flange is most clearly shown in FIG. 3). The flange 144 is formed by one of the lateral ribs 138. As shown in the example of FIG. 2, the flange 144 is positioned within a dimensional envelope of the associated ring segments 102. As described in connection with FIGS. 6-12, the flange 144 can be used by a fixation tool 146 (See, FIG. 8) to hold the anchor 120 in place during a pre-cast concreting process during which the anchor 120 is embedded within the ring segment 102. The fixation tool 146 also allows the anchor 120 to be consistently positioned within the ring segment 102 when the ring segments 102 are formed and when the anchors 120 are coupled within the ring segments 102.

Referring back to the anchor 120, a second portion 148 of the central portion 124 of the anchor 120 extends from the ring segments 102. A plane defined by and/or between the radial end surfaces 110 bisects the first and second portions 143, 148 of the anchor 120. Thus, in the example shown, approximately half of the central portion 124 is within a dimensional envelope of the ring segment 102 and approximately half of the central portion 124 extends out of the dimensional envelope of the ring segment 102. Positioning the second portion 148 to extend from the ring segments 102 allows the second portion 148 of the anchor 120 to be received within the recess 130 of the adjacent ring segments 102 during the coupling process. As a result, when the radial end surfaces 110 are adjacent one another and the ring segments 102 are coupled as shown in FIG. 2, the central portions 124 and the associated bores 126 of the anchors 120 are coaxially aligned.

Referring back to FIG. 3, an expanded isometric view of the radial coupling 116 is depicted including the anchors 120 and the pin 122. In the example shown, the anchors 120 do not include a plurality of break-away segments 150 (the break-away segments are most clearly shown in FIG. 6) because the break-away segments 150 have been broken off from the flange 144. The break-away segments 150 are further described in connection with FIGS. 6-12.

In the example shown, the pin 122 has a central portion 152, a plurality of tapered portions 153 and a plurality of distal portions 154. The tapered portions 153 are positioned between the central portion 124 and the associated distal portions 154. The central portion 124 has a larger diameter than the distal portions 154 and the distal portions 154 have rounded ends and/or edges. The pin 122 is sized to be received within a plurality of diameter portions 156, 158 of the bores 126 of the anchor 120 (the diameter portions 156, 158 of the bore 126 are most clearly shown in FIG. 5).

Referring to the anchors 120 shown in FIG. 3, the second portion 148 of the anchor 120 includes a protrusion 162 and the legs 128 include an inner side 164 and an outer side 166. The inner side 164 is relatively smooth between the sides 140, 142 of the legs 128. The ribs 132 project from the outer side 166. Each leg 128 also includes a tongue 168, which extends transversely outward from the leg 128. Upon the anchors 120 being embedded into the ring segments 102, 104, the tongues 168 interact with the material forming the ring segments 102, 104 to reduce the likelihood that the anchors 120 are inadvertently removed from the ring segments 102, 104. As also shown, the flange 144 extends around three sides of the anchor 120. Specifically, the flange 144 extends between the first and second sides 140, 142 of the legs 128 and around the protrusion 162 of the central portion 124. As described in connection with FIGS. 6-12, the flange 144 can be used by the fixation tool 146 (See, FIG. 8) to hold the anchor 120 in place during a pre-cast concreting process during which the anchor 120 is embedded within the ring segment 102.

Figure 4:
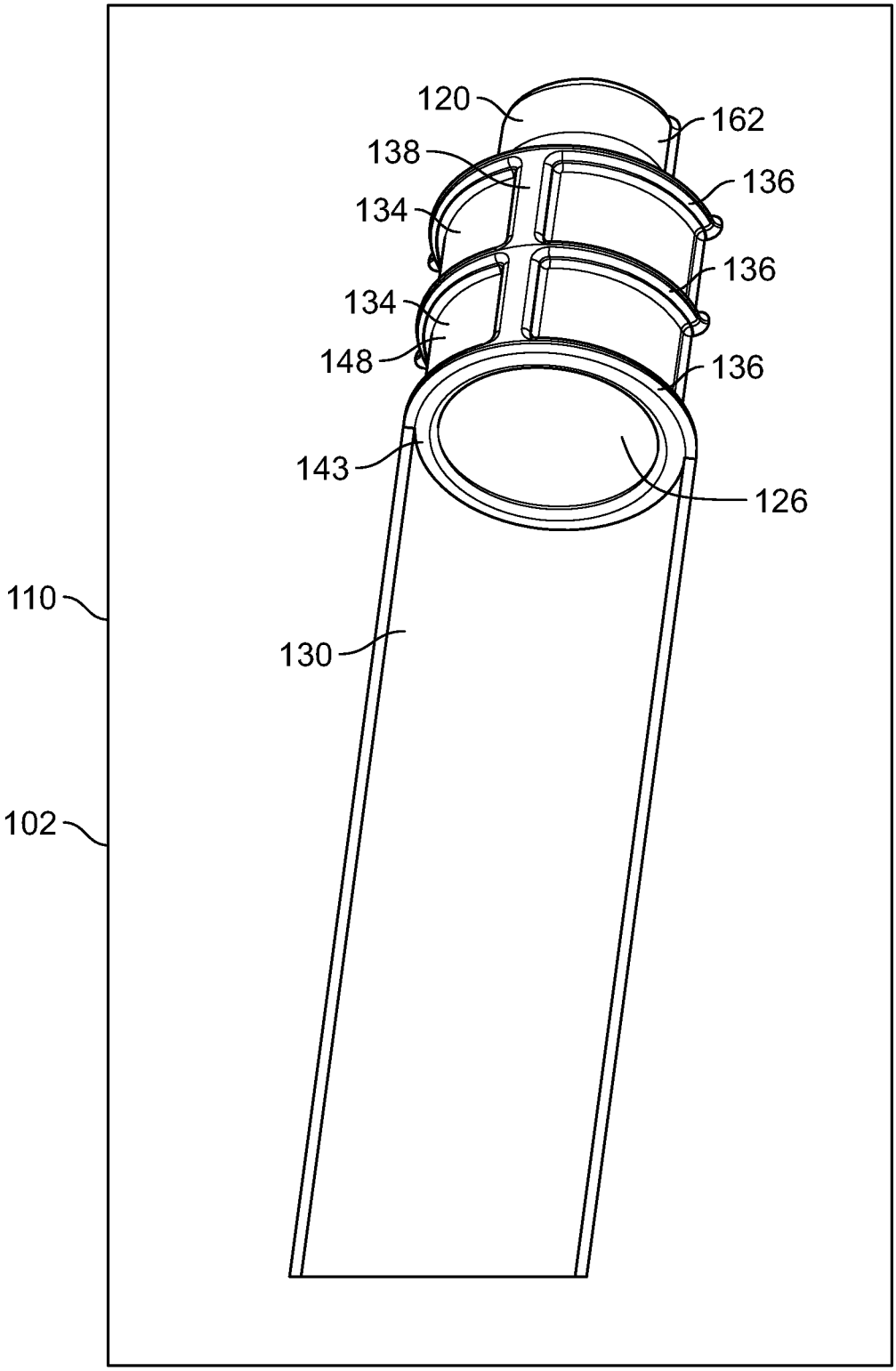
FIG. 4 is a detailed isometric view of one of the ring segments of FIG. 1 defining a recess and carrying one of the anchors of the radial coupling.

FIG. 4 illustrates a detailed isometric view of one radial end surface 110 of the ring segments 102, 104 defining the recess 130 and including one of the embedded anchors 120. In the example shown, the bore 126 of the anchor 120 opens into the recess 130, the first portion 143 of the central portion 124 of the anchor 120 is received by the ring segment 102 and the second portion 148 of the central portion 124 of the anchor 120 extends from the radial end surface 110. So configured, the pin 122 and the anchor 120 carried by the other ring segment 102, 104 are able to be positioned within and moved along the recess 30 during the coupling process.

Figure 5:
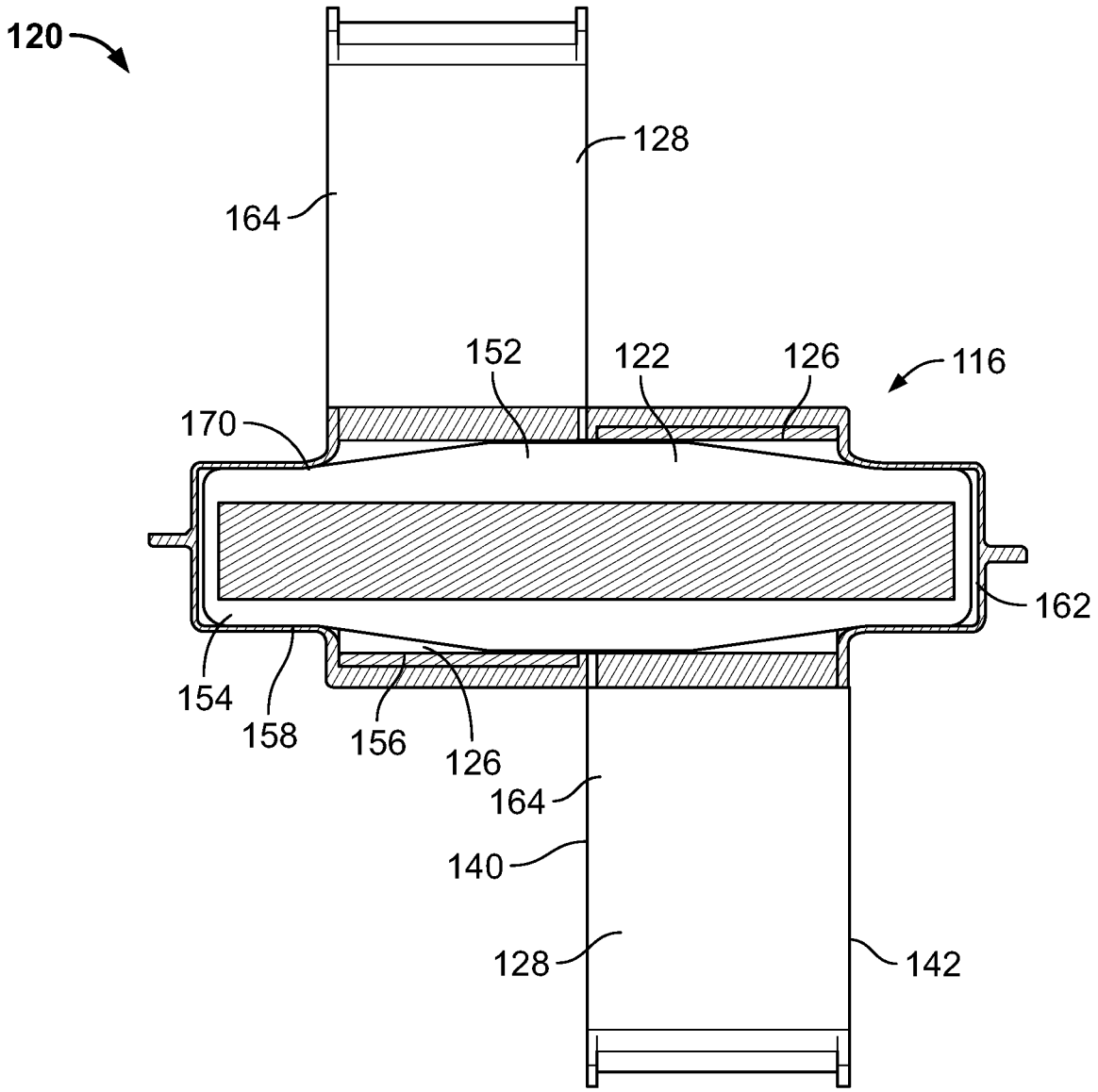
FIG. 5 is a cross-sectional view of one of the radial couplings showing the pin received within bores of the anchors to couple the ring segments together and also showing legs of the anchors embedded within the respective ring segments.

FIG. 5 is a cross-sectional view of the radial coupling 116 after assembly showing the pin 122 being received by the bores 126 of two of the anchors 120. The central portion 152 of the pin 122 is shown positioned within the first diameter portion 156 of the bore 126 of the anchor 120 and the distal portions 154 of the pin 122 are shown received within the second diameter portions 158 of the bore 126 of the anchor 120. The first diameter portion 156 of the bore 126 is defined by the central portion 124 of the anchor 120 and is positioned substantially between the sides 140, 142 of the legs 128 and the second diameter portion 158 of the bore 126 is defined by the protrusion 162 of the central portion 124 that extends beyond the side 142 of the leg 128.

In the example shown, an interior surface 170 that defines the bore 126 of the anchor 120 is tapered. The interior surface 170 may be engaged by the pin 122 to guide the distal portion 154 of the pin 122 within the second diameter portion 158. A seal formed between the pin 122 and the interior surface 170 deters the ingress of fluid (e.g., water) within the coupling and/or the anchor 120 that may cause damage (e.g., erosion, etc.).

Figure 6:
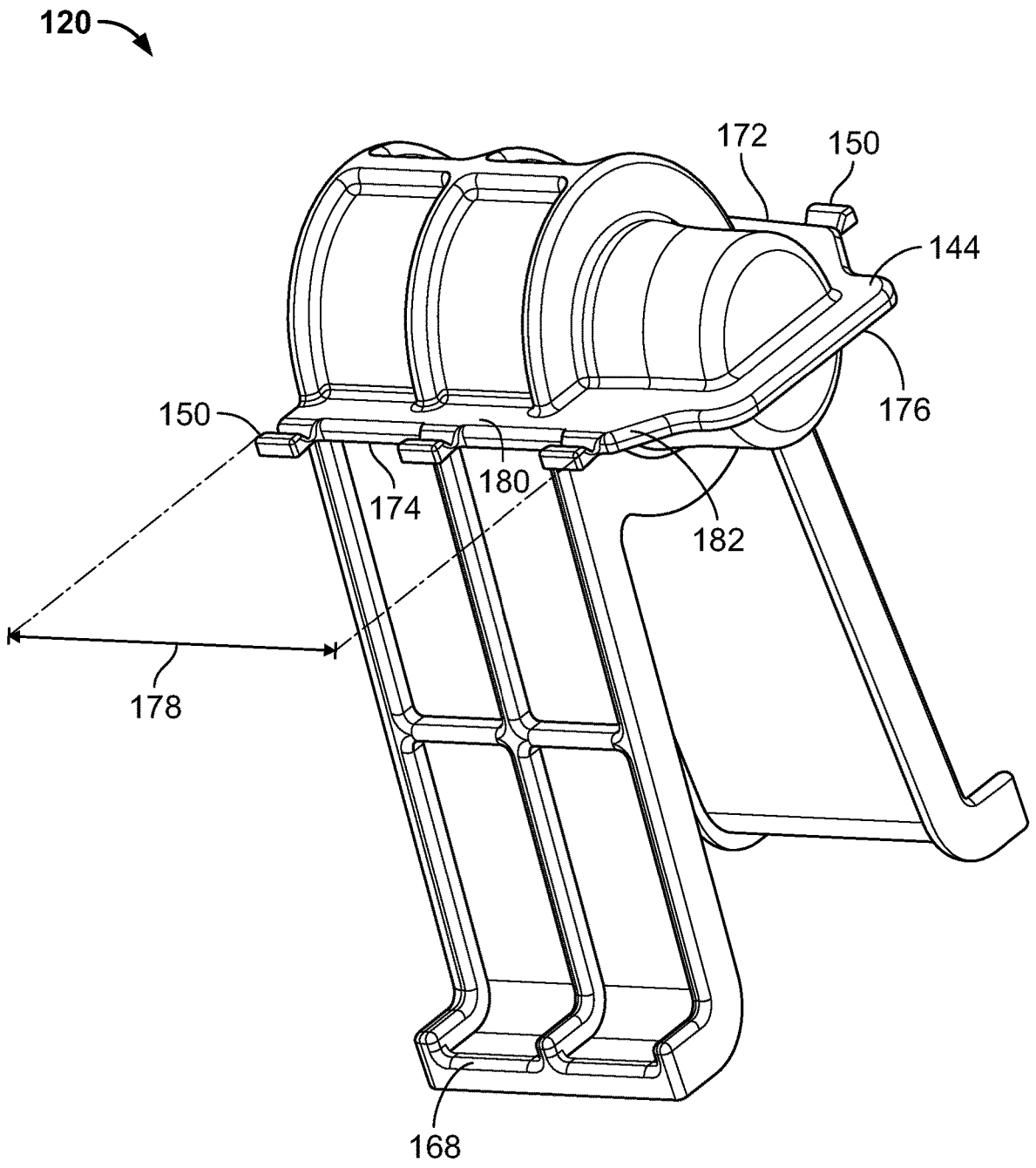
FIG. 6 is an isometric view of one of the anchors including the break-away segments extending from a flange of the anchor.

FIG. 6 illustrates an isometric view of one of the anchors 120. In contrast to the anchors 120 shown in FIG. 3, the anchor 120 of FIG. 6 includes the break-away segments 150. The break-away segments 150 are used during the pre-cast concreting process to hold the anchor 120 in place as further described in connection with FIGS. 8-12. In the example shown, the break-away segments 150 are tabs that laterally extend from the flange 144 on a first side 172 of the anchor 120 and a second side 174 of the anchor 120 but are not positioned on a third side 176 of the anchor 120. While three break-away segments 150 are included on each of the first side 172 and the second side 174 of the anchor 120, a different number of break-away segments 150 may be included instead. If a different number of break-away segments 150 are included, a width 178 of a portion 180 of the flange 144 may change. For example, if two break-away segments 150 are included instead of three, the width 178 may decrease and a position of a tapered portion 182 of the flange 144 may also change accordingly.

Figure 7:
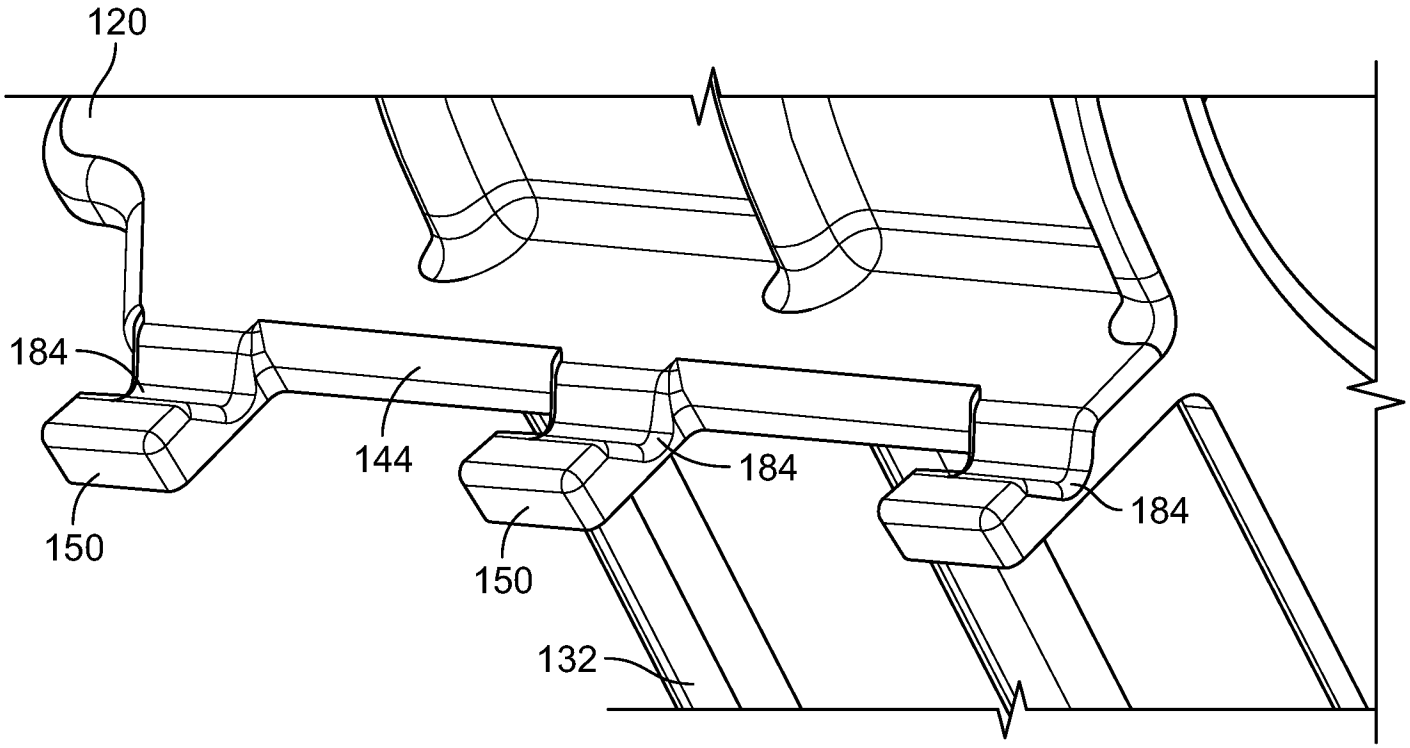
FIG. 7 is a detailed view of the anchor of FIG. 6 showing a plurality of notches of the break-away segments.

FIG. 7 illustrates a detailed view of the anchor 120 of FIG. 6. In the example shown, the break-away segments 150 include a plurality of notches 184. The notches 184 are V-shaped and are positioned immediately adjacent the flange 144. As a result, when the break-away segments 139 are removed from the flange 144 (broken off of the flange 144), a minimal amount of the break-away segments 150 (if any) remain attached to the flange 144.

Figure 8:
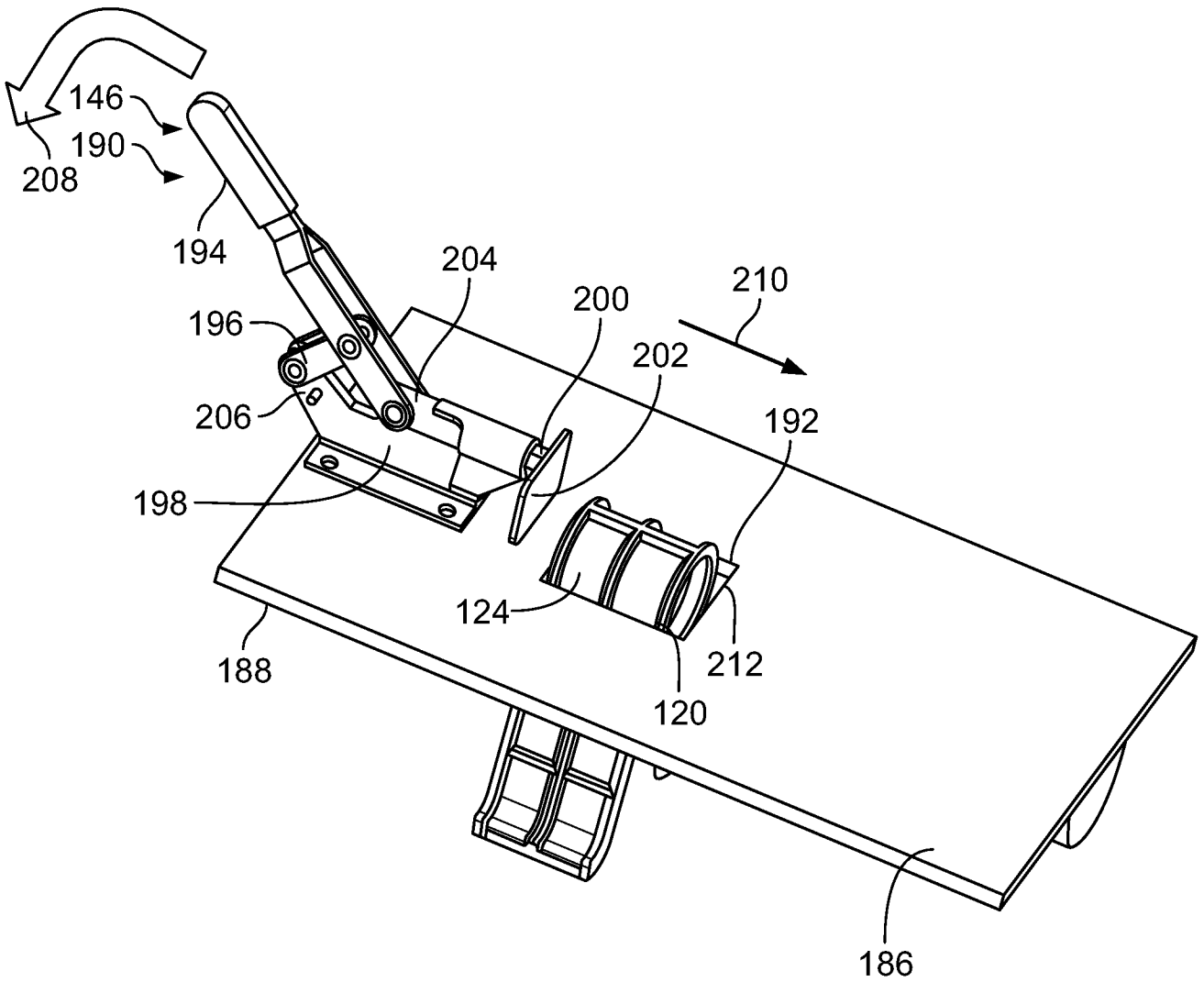
FIG. 8 is an isometric view of a first side of a fixation tool having a base defining an aperture and including a lever assembly in an open position and also showing a central portion of one of the anchors positioned within the aperture of the base of the fixation tool.

FIG. 8 is an isometric view of a first side 186 of the fixation tool 146 and one of the anchors 120. In the example shown, the fixation tool 146 includes a base 188 and a lever assembly 190 coupled to the base 188. The base 188 defines an aperture 192. The central portion 124 of the anchor 120 is positioned within and extends through the aperture 192. The lever assembly 190 includes a handle 194, a link 196, a guide 198, a rod 200 and an engagement surface 202. The handle 194 is pivotably coupled to a distal end 204 of the rod 200 and is also pivotably coupled to the link 196. The link 196 is pivotably coupled to a portion 206 of the guide 198. The rod 200 is partially positioned within the guide 198 and is coupled to the engagement surface 202.

To actuate the lever assembly 1910, the handle 194 is moved in a direction generally indicated by arrow 208, causing the handle 194 to pivot relative to the rod 200 and the link 196 and for the rod 200 and the engagement surface 202 to move in a direction generally indicated by arrow 210. As shown, the lever assembly 190 is in an open position and the anchor 120 is spaced from a front edge/surface 212 of the base 188 that defines the aperture 192. In the open position of the lever assembly 190, the engagement surface 202 of the lever assembly 190 is spaced from the anchor 120.

Figure 9:
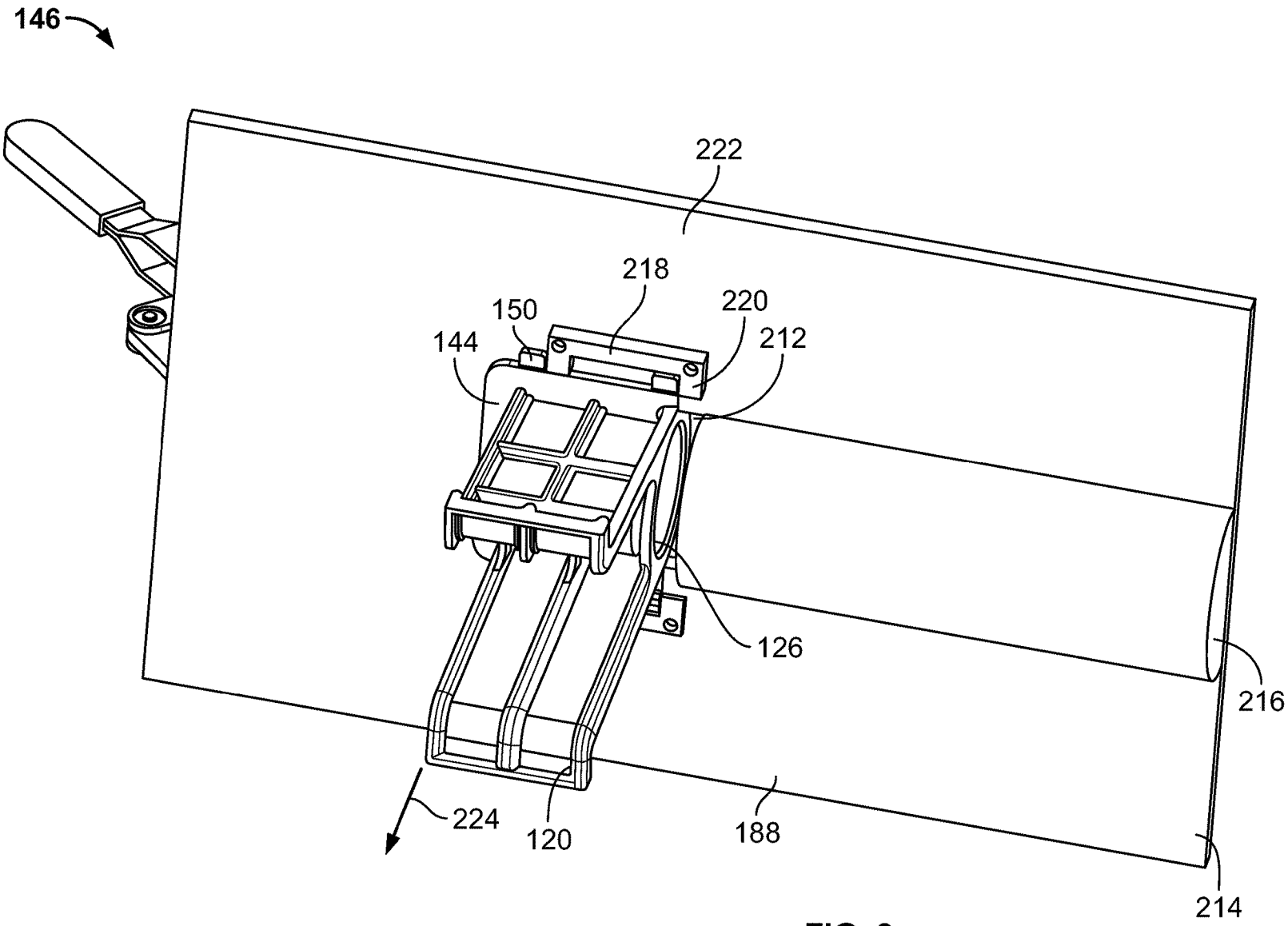
FIG. 9 is an isometric view of a second side of the fixation tool illustrating the base having a semi-cylindrical portion and including holders having tabs spaced from a surface of the base. The semi-cylindrical portion is adapted to form the recess in the ring segment. A slot formed between the tabs and the surface of the base is adapted to receive the break-away segments of the anchor to secure the anchor relative to the fixation tool.

FIG. 9 is an isometric view of a second side 214 of the fixation tool 146. The base 188 includes a semi-cylindrical portion 216 and holders 218 having tabs 220. The semi-cylindrical portion 216 faces the bore 126 of the anchor 120 and is adapted to form the recess 130 during the pre-cast concreting process. The tabs 220 are spaced from a surface 222 of the base 188 (more clearly shown in FIG. 10) to allow the break-away segments 150 to be slid under the tabs 220 when the lever assembly 190 is in the closed position. Positioning the break-away segments 150 between the tab 220 and the base 188 prevents the anchor 120 from moving out of the aperture 192 of the fixation tool 146 in a direction generally represented by arrow 224 once the anchor 120 is fixed within the fixation tool 146. The flange 144 is shown engaging the surface 222 of the base 188 adjacent the aperture 192. The interaction between the flange 144 and the base 188 prevents the anchor 120 from moving further into the aperture 192 of the base 188 in a direction generally opposite that indicated by the arrow 224.

Figure 10:
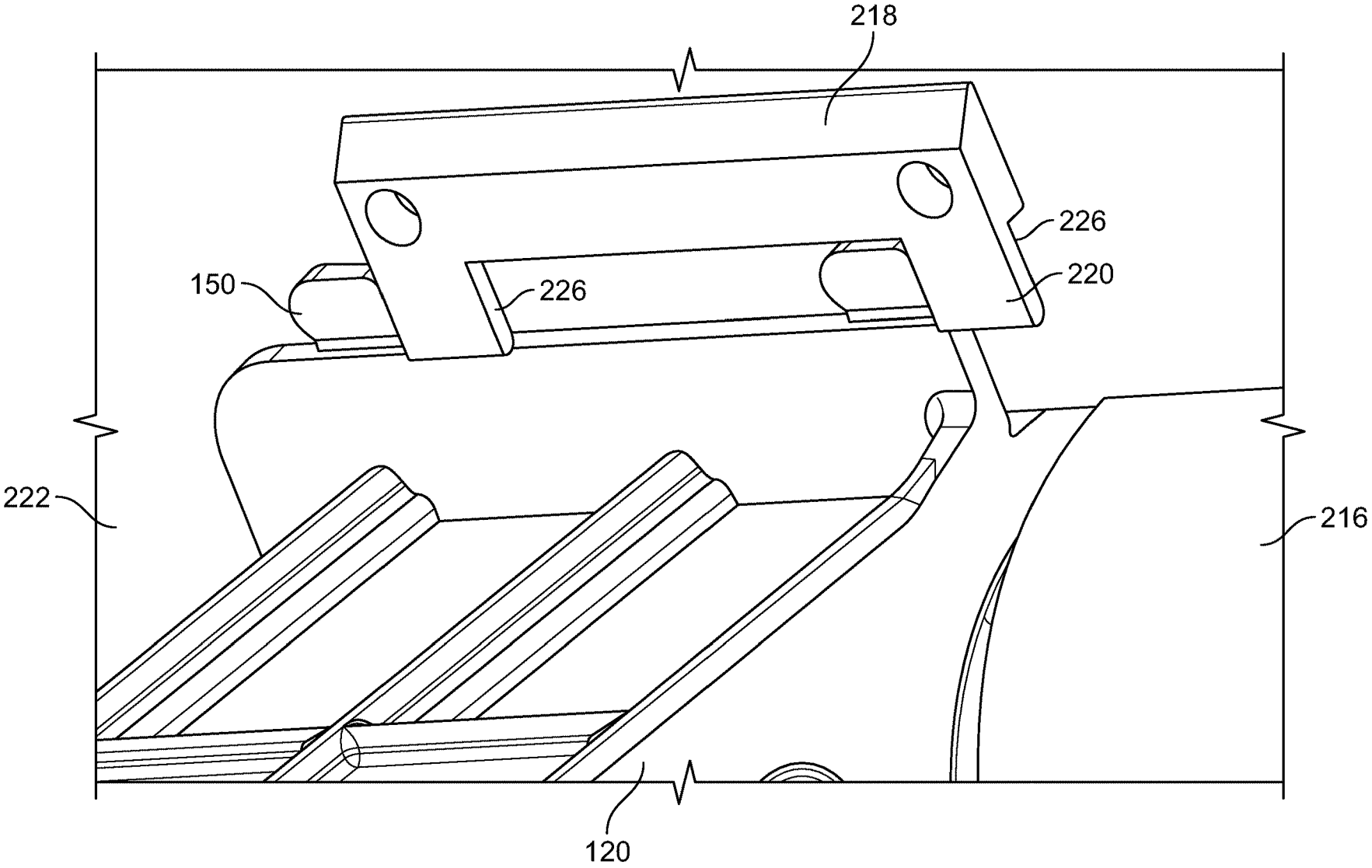
FIG. 10 is a detailed isometric view of the fixation tool and the anchor of FIG. 9 showing the holder, the tabs forming the slots and the break-away segments of the anchor.

FIG. 10 is a detailed isometric view of the holder 218, the tabs 220 and the break-away segments 150. A plurality of slots 226 are formed between the tabs 220 and the base 188. The slots 226 allow the break-away segments 150 to be received between the tabs 220 and the surface 222 of the base 188 when the anchor 120 is fixed within the fixation tool 146 and the lever assembly 190 is in the closed position.

Figure 11:
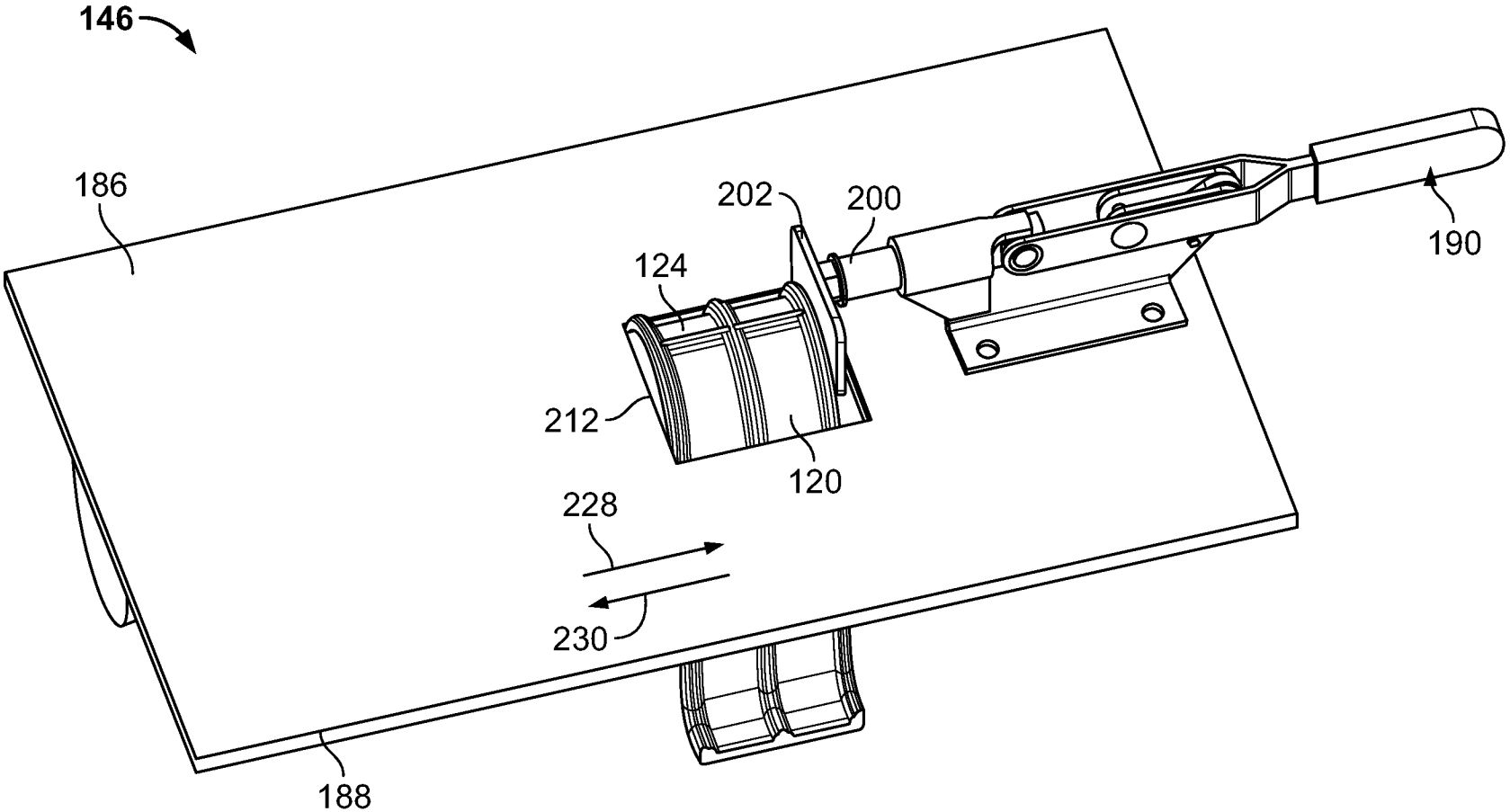
FIG. 11 is an isometric view of the first side of the fixation tool showing the lever assembly in the closed position and one of the anchors clamped within the aperture defined by the base of the fixation tool.

FIG. 11 is an isometric view of the first side 186 of the fixation tool 146 and one of the anchors 120. In the example shown, the lever assembly 190 is in the closed position and the rod 200 and the engagement surface 202 are in the extended position. The central portion 124 of the anchor 120 is clamped between the engagement surface 202 of the lever assembly 190 and the front surface 212 of the base 188 to prevent the anchor 120 from moving in directions generally represented by arrows 228, 230.

Figure 12:
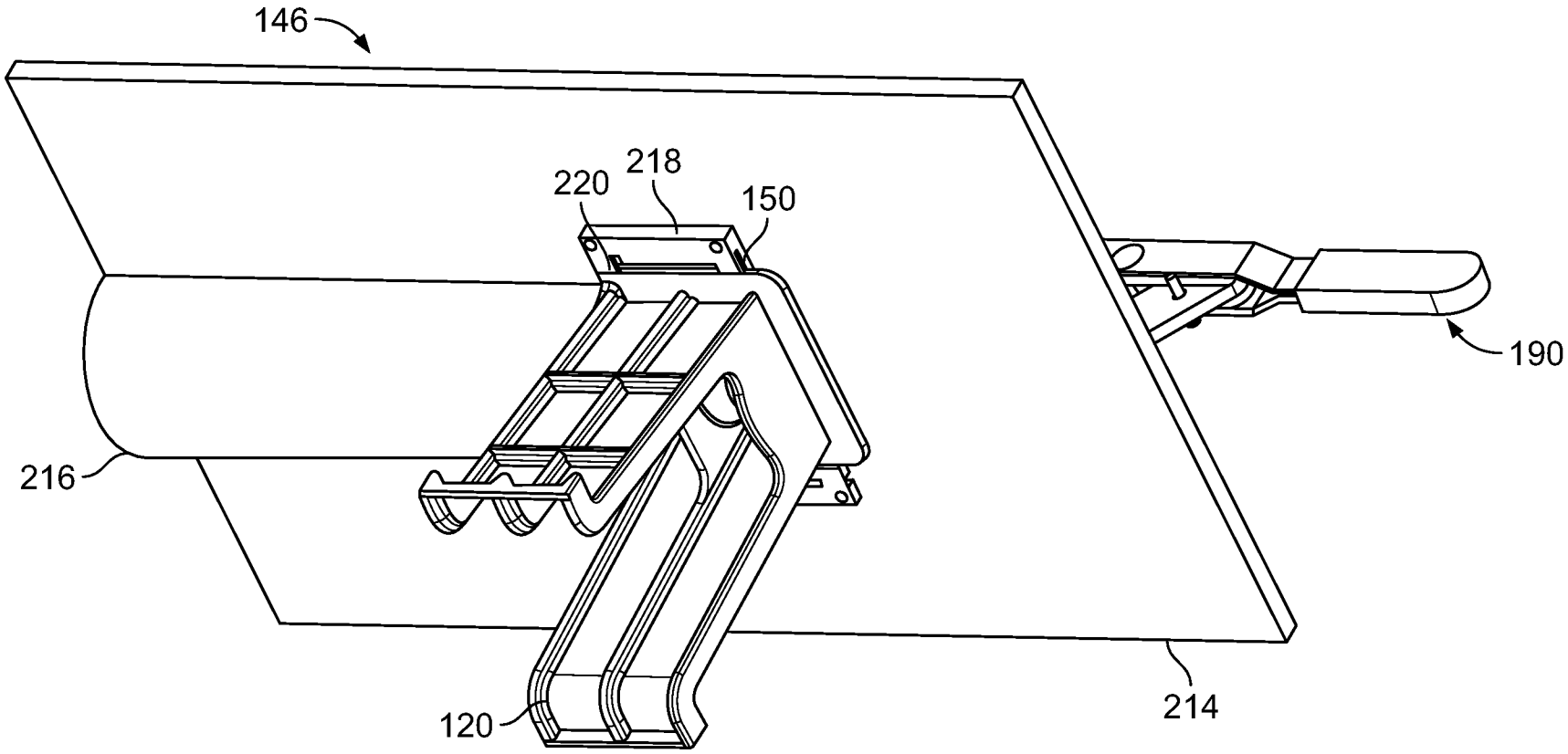
FIG. 12 is an isometric view of the second side of the fixation tool with the lever assembly in the closed position and the break-away segments of the anchor positioned within the slots defined between the tabs and the base.

FIG. 12 is an isometric view of the second side 214 of the fixation tool 146 with the lever assembly 190 in the closed (actuated) position. In the closed position, the anchor 120 is driven against the semi-cylindrical portion 216 of the fixation tool 146 and the break-away segments 150 are positioned beneath the tabs 220 of the holder 218. With the anchor 120 fixed to the fixation tool 146, the fixation tool 146 can be coupled to a casting form and concrete can be poured into the casting form to form the ring segment 102. After the concreting process, the fixation tool 146 is removed from the ring segment 102 and the break-away segments 150 snap-off (break), uncoupling the anchor 120 from the fixation tool 146 and allowing the bore 126 of the anchor 120 to open into the recess 130.

While the couplings of the present disclosure have thus far been described as "radial" couplings used in connection with coupling radial end faces of ring segments for use in tunnel building applications, in other versions, the same couplings could be used to couple other prefabricated or pre-cast building materials. For example, the couplings could be used to couple adjacently positioned side faces of vertically arranged pre-cast concrete wall sections for retaining walls or building foundations, or side faces of horizontally arranged pre-cast concrete slabs for floor or road construction, for example. Other applications are possible.

Further, while several examples have been disclosed herein, any features from any examples may be combined with or replaced by other features from other examples. Moreover, while several examples have been disclosed herein, changes may be made to the disclosed examples without departing from the scope of the claims.

What is claimed is:

1. A construction coupling for connecting prefabricated segments, the construction coupling comprising;

a pair of anchors, each anchor comprising a central portion and a pair of legs, the central portion defining an elongated bore, the pair of legs extending from opposite sides of the central portion, each leg extending in a direction generally transverse to the elongated bore and having a proximal end attached to the central portion and a free distal portion disposed away from the central portion; and a pin adapted to be received in the elongated bores of the pair of the anchors to connect the pair of the anchors together, wherein the legs comprise a first side and a second side and wherein the central portion comprises a protrusion, the protrusion of the central portion extends beyond the second side of the legs.

2. The construction coupling of claim 1, wherein each leg of each anchor includes a generally planar structure extending generally transverse to the elongated bore.

3. The construction coupling of claim 1, wherein the pair of legs of each anchor extends at an angle relative to each other, the angle in the range of approximately 0 degrees to approximately 90 degrees.

4. The construction coupling of claim 1, wherein the free distal portion of each leg comprises a tongue extending transversely away from the remainder of the leg.

5. The construction coupling of claim 1, wherein each leg of the anchors comprises a plurality of ribs forming a skeleton and a panel.

6. The construction coupling of claim 1, wherein one or more of the anchors comprises a flange that extends around at least a portion of the central portion of the anchor.

7. The construction coupling of claim 1, wherein the elongated bore of each anchor comprises a blind bore with an opening having a first diameter and a closed end having a second diameter that is smaller than the first diameter.

8. The construction coupling of claim 7, wherein the pin comprises a third diameter portion, a tapered portion, and a fourth diameter portion, the tapered portion positioned between the third diameter portion and the fourth diameter portion, the third diameter portion of the pin being sized to be received within the opening of the blind bore and the fourth diameter portion of the pin being sized to be received within the closed end of the blind bore.

9. The construction coupling of claim 1, wherein each anchor comprises a generally omega-shaped anchor.

10. The construction coupling of claim 1, wherein each leg includes a plurality of reinforcing ribs and a panel from which the reinforcing ribs extend.

11. The construction coupling of claim 10, wherein the reinforcing ribs include a plurality of lateral ribs.

12. The construction coupling of claim 10, wherein the reinforcing ribs include a plurality of longitudinal ribs and a plurality of lateral ribs.

13. The construction coupling of claim 12, wherein the longitudinal ribs intersect the lateral ribs.

14. The construction coupling of claim 10, wherein each of the legs include an inner side and an outer side, the inner side being relatively smooth between the sides of the corresponding legs.

15. The construction coupling of claim 14, wherein the reinforcing ribs extend from the outer side of the legs.

16. A ring of a tunnel, comprising:

a plurality of pairs of anchors, each anchor comprising a central portion and a pair of legs, the central portion defining an elongated bore, the pair of legs extending from opposite sides of the central portion, each leg extending in a direction generally transverse to the elongated bore and having a proximal end attached to the central portion and a free distal portion disposed away from the central portion;

a plurality of ring segments comprising radial end surfaces, each radial end surface carrying one of the pairs of anchors and defining corresponding recesses; and a plurality of pins, each pin adapted to be received in the elongated bores of corresponding ones of the anchors to connect the pair of anchors together, wherein the legs comprise a first side and a second side and wherein the central portion comprises a protrusion, the protrusion of the central portion extends beyond the second side of the legs.

17. The ring of claim 16, wherein the radial end surfaces of two of the ring segments abut one another, the central portion of the anchor carried by a first one of the ring segments is positioned within the recess of a second one of the ring segments.

18. The ring of claim 16, wherein each of the recesses has a semi-cylindrical shape.

19. The radial coupling of claim 16, wherein one or more of the anchors comprises a flange that extends around at least a portion of the central portion of the anchor.

20. The ring of claim 16, wherein each anchor comprises a generally omega-shaped anchor.

21. The ring of claim 16, wherein, when the radial end surfaces of the ring segments are adjacent one another and the ring segments are coupled together, the anchor of one of the ring segments is positioned in the recess of another one of the ring segments.

* * * * *